US008006426B1

(12) United States Patent
Carroll

(10) Patent No.: US 8,006,426 B1
(45) Date of Patent: Aug. 30, 2011

(54) SHOOTING REST APPARATUS

(76) Inventor: Jim Carroll, Montrose, CO (US)

( * ) Notice: Subject to any disclaimer, the term of this patent is extended or adjusted under 35 U.S.C. 154(b) by 195 days.

(21) Appl. No.: 12/576,128

(22) Filed: Oct. 8, 2009

Related U.S. Application Data

(63) Continuation-in-part of application No. 11/759,150, filed on Jun. 6, 2007, now abandoned.

(60) Provisional application No. 60/804,050, filed on Jun. 6, 2006.

(51) Int. Cl.
*F41C 27/00* (2006.01)

(52) U.S. Cl. ..... 42/94; 73/167

(58) Field of Classification Search ..... 42/94; 76/167; 89/37.03, 37.04
See application file for complete search history.

(56) References Cited

U.S. PATENT DOCUMENTS

| | | | | |
|---|---|---|---|---|
| 2,427,365 | A | 9/1947 | Meister | |
| 4,621,563 | A | 11/1986 | Poiencot | |
| 5,272,955 | A * | 12/1993 | Bond et al. | 89/37.04 |
| 5,811,720 | A | 9/1998 | Quinnell et al. | |
| 6,931,777 | B1 | 8/2005 | Krien | |

* cited by examiner

*Primary Examiner* — Michael Carone
*Assistant Examiner* — Daniel Troy
(74) *Attorney, Agent, or Firm* — Crossley Patent Law; Mark A. Crossley

(57) ABSTRACT

The shooting rest apparatus provides for a shooter to effectively engage moving targets as well as stationary targets. Among the advantages provided by the forestock-only grip of a rifle within the apparatus is that firearms with extended magazines protruding from the bottom of the firearm are accommodated. Felt recoil reduction is a further desirable benefit provided by an adjustable recoil adjustment mechanism. Recoil is absorbed through fore and aft movement only, without barrel elevation. Pistols are also supported by the apparatus.

20 Claims, 7 Drawing Sheets

SHOOTING REST APPARATUS

I claim benefit of my previously filed U.S. application Ser. No. 11/759,150 filed Jun. 6, 2007 and my U.S. Provisional Application No. 60/804,050 filed Jun. 6, 2006.

BACKGROUND OF THE INVENTION

Various shooting rests have been provided in prior art. What has not been provided is a shooting rest that allows a shooter to quickly and effectively engage moving targets as well as stationary targets. What has been further lacking in the art is a shooting rest that will accommodate rifles with extended magazines protruding from the bottom of the firearm. Felt recoil reduction is a further desirable benefit of a shooting rest. The present apparatus provides these advantages and more over prior art. The present apparatus provides increased firearm accuracy, fast target acquisition, smooth recoil absorption without barrel elevation, instructional ease, and lightweight portability.

SUMMARY OF THE INVENTION

The present shooting rest apparatus provides a shooting rest with a recoil slide system for firearms such as rifles, smoothbores, and shotguns. The apparatus has a cushioned vise for locking in the forestock of such firearms, thereby holding the firearm securely. Clamping only the forestock of the firearm further differentiates the present apparatus from prior firearm shooting rests, as no limitations are placed upon rearward dimensions of the firearm. Those using firearms possessing extended magazines quickly understand this advantage. Clamping only the forestock greatly hastens firearm attachment and also provides greater firearm accuracy. Clamping only the forestock of the firearm enables full access to the firearm for cleaning, inspection, or other given pursuit. The apparatus is a compact, freestanding, lightweight unit that allows a shooter to freely and accurately move the gun sights to a target. The vise that holds the rifle or smoothbore is hinged in the front to allow vertical movement of the firearm via the spring-assisted rod and cylinder in the rear. The base of this apparatus has three adjustable contact points for a surface the apparatus may be placed on. The trilogy of base height adjustments provides vertical and side-to-side tilt adjustments of the apparatus. The upper part of this apparatus is attached to the support base with a horizontal pivot bolt used as a pivot point which allows the firearm to freely swing to the right or the left with the lever of the pivot bolt loosened. The vise that holds the firearm is attached to the apparatus by two ball bearing slides that allow the firearm to move straight back upon firing. A pair of relatively strong recoil reduction springs is provided. One of each spring is mounted on each side of the vise and to the vertical adjustment base. The springs reduce recoil felt by the shooter, while simultaneously keeping the firearm on target without barrel elevation. Additionally, more complete embodiments of the recoil mechanism provide tension adjustments. Further, the recoil reduction mechanism may also be provided with hydraulic or gas dampening. Side pivotal adjustment via the horizontal adjustment plate provides for firearm barrel movement from side to side, and the horizontal lever locks the chosen adjustment, as desired. The vertical adjustment knob provides use on either side of the cylinder so that vertical adjustment of the rear of the vertical adjustment base is right or left hand friendly. A totally unique feature of the apparatus is the ability to follow a moving target. Unlocking the horizontal lever and knob allows following a target from side to side. Unlocking the vertical adjustment knob provides up and down movement of the rod within the cylinder to allow the rear of the vertical adjustment base to move up and down. Further, the rod within the cylinder is spring loaded.

Additionally, by clamping the v-designed pistol rest block into the vise along, optionally, with a piece of dense foam block, the apparatus becomes a shooting rest for pistols. This design allows the shooter to steadily hold the pistol sights on target when firing the gun.

A handle on the front of the apparatus provides for convenient carrying. The apparatus is provided in various materials which include but are not limited to metals, alloys, synthetics and combinations of same.

The vise is lined with a resilient elastomeric material to protect the rifle or shotgun.

Thus, has been broadly outlined the more important features of the improved shooting rest apparatus so that the detailed description thereof that follows may be better understood and in order that the present contribution to the art may be better appreciated.

An object of the present shooting rest apparatus is to provide a shooting rest which increases accuracy of hitting a target.

Another object of the present shooting rest apparatus is to provide for fast target acquisition.

A further object of the present shooting rest apparatus is to reduce felt recoil.

Yet a further object of the shooting rest apparatus is to provide for only backward recoil, without barrel elevation.

And, still another object of the shooting rest apparatus is to provide for tension adjustment in the recoil reduction mechanism.

Additionally, an object of the shooting rest apparatus is to prevent unpleasant shooter anticipation normally associated with firing a firearm.

Still another object of the shooting rest apparatus is to provide greater accuracy in hitting long-range targets.

An additional object of the shooting rest apparatus is to provide assistance in instruction of new shooters, especially women and children.

A still further object of the shooting rest apparatus is to provide for easily following a moving target.

An even further object of the shooting rest apparatus is to provide a lightweight, portable, and stable shooting rest.

Yet another object of the shooting rest apparatus is to provide the above-listed objects in a basic, easy to use design.

These together with additional objects, features and advantages of the improved shooting rest apparatus will be readily apparent to those of ordinary skill in the art reading the following detailed description of the presently preferred, but nonetheless illustrative, embodiments of the improved shooting rest apparatus when taken in conjunction with the accompanying drawings.

DETAILED DESCRIPTION OF THE DRAWINGS

With reference now to the drawings, and in particular FIGS. 1 through 5 thereof, the shooting rest apparatus generally designated by the reference number 10 will be described.

Figure 1:
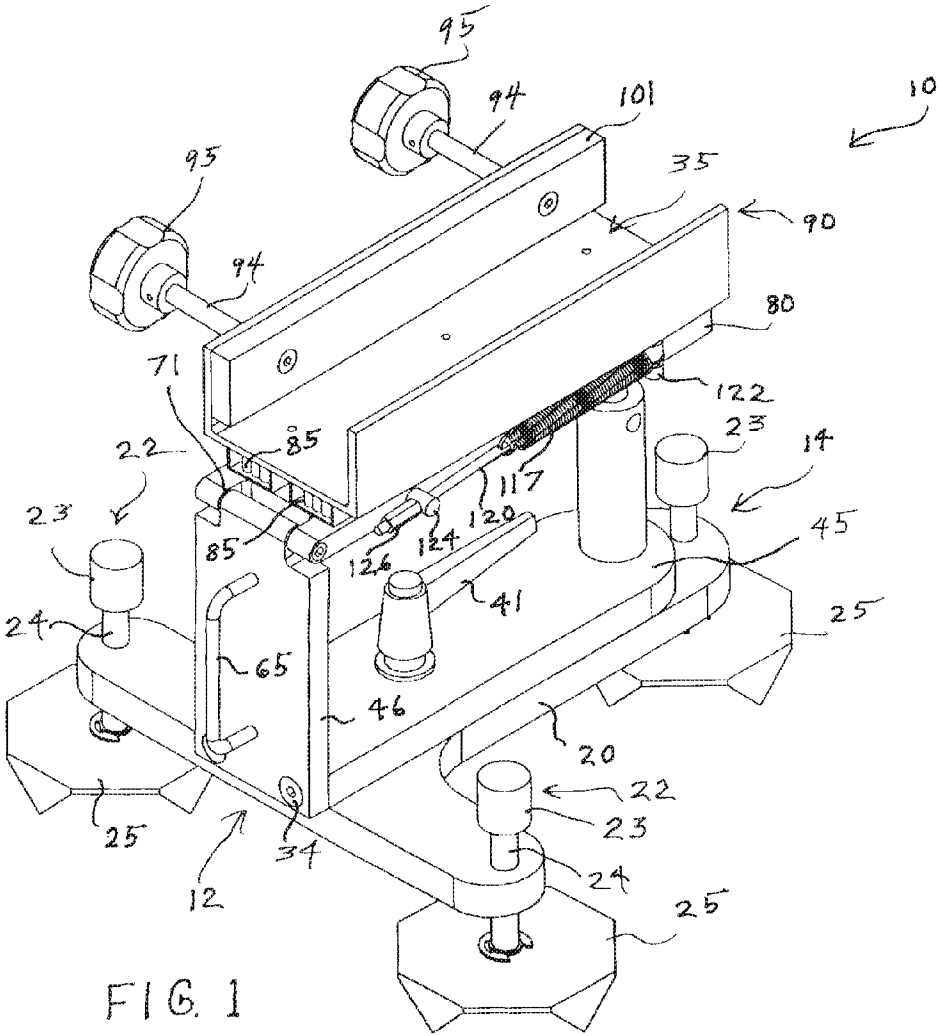
FIG. 1 is a right frontal perspective view.
Figure 2:
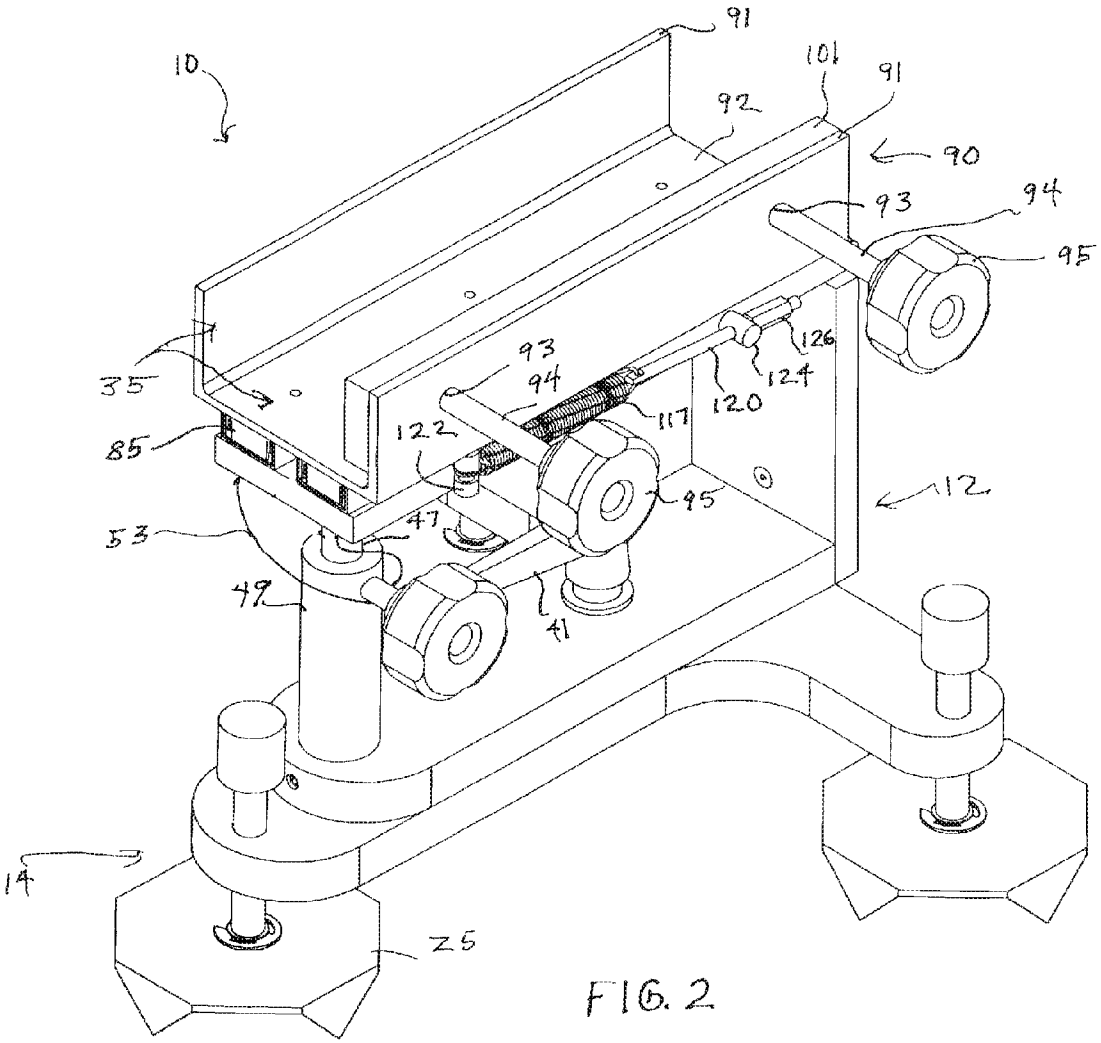
FIG. 2 is a left rear perspective view.
Figure 3:
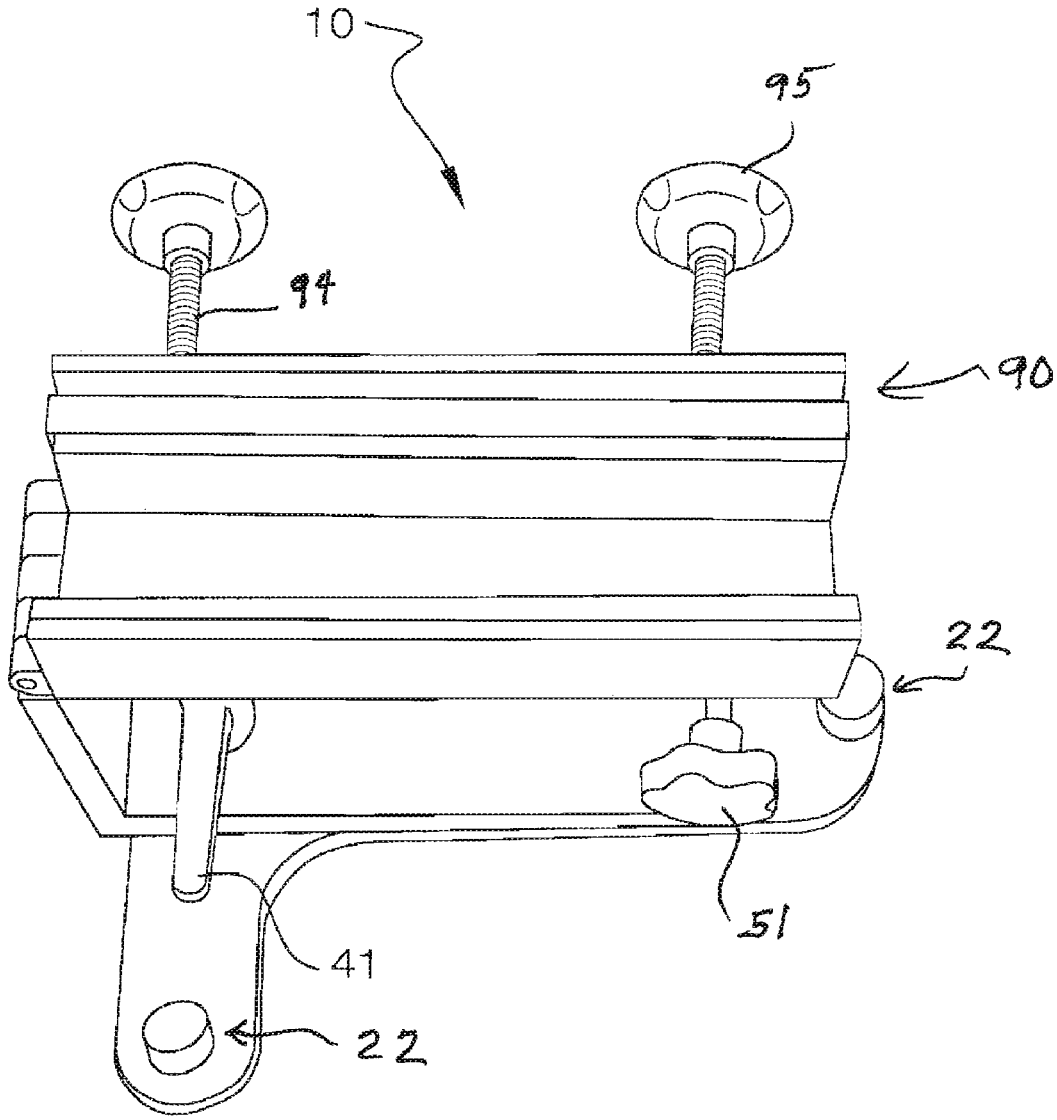
FIG. 3 is a top perspective view.
Figure 5:
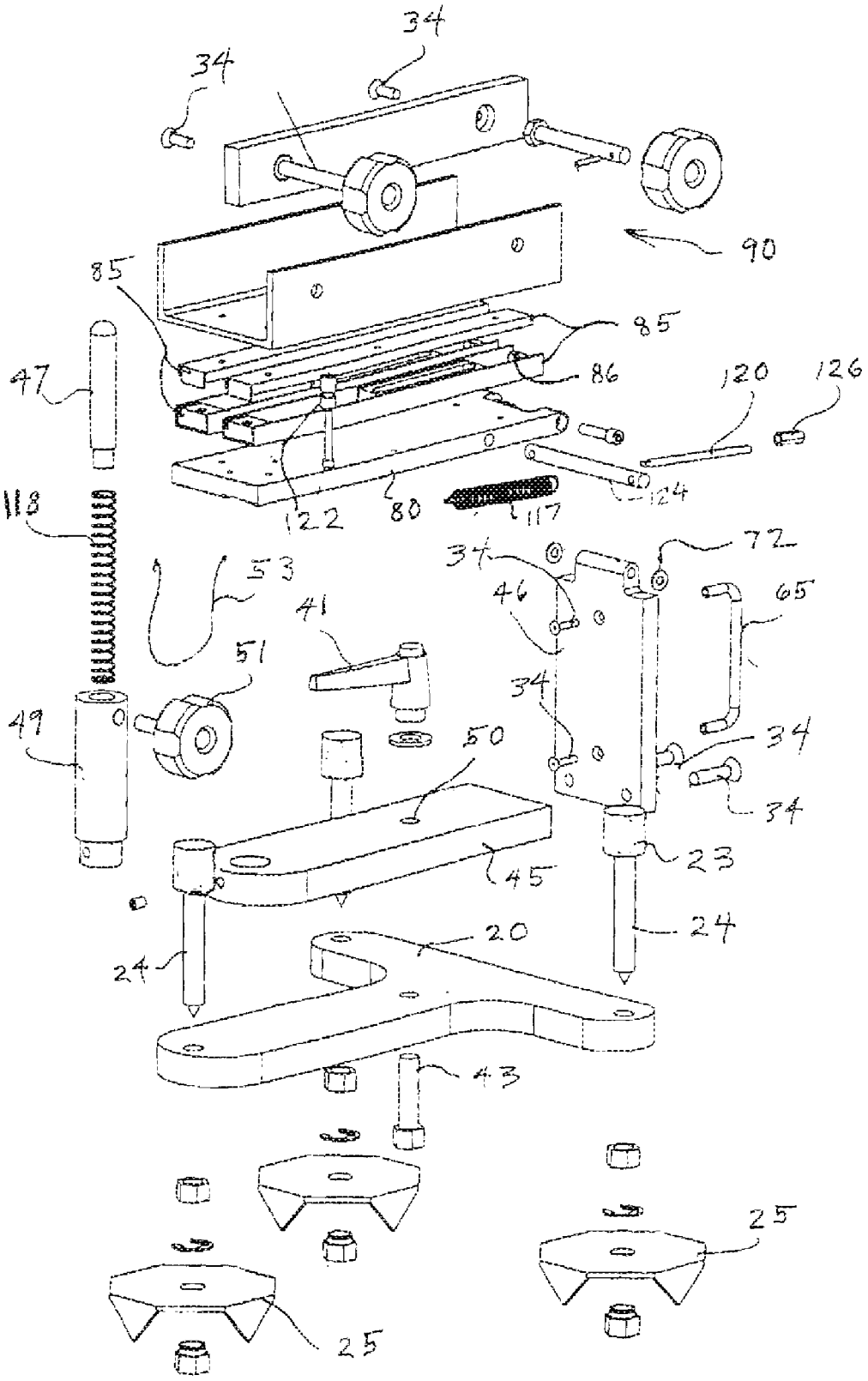
FIG. 5 is an exploded perspective view.
Figure 6:
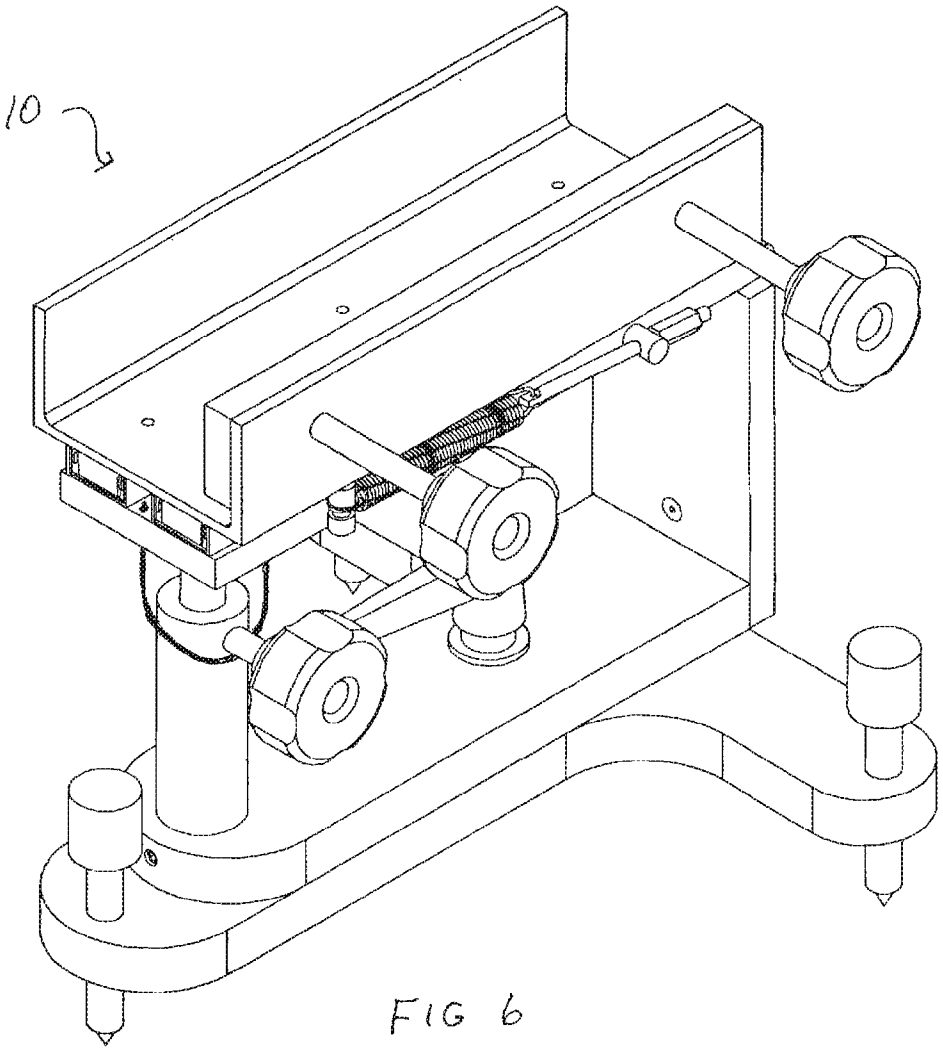
FIG. 6 is a perspective view of the device without the grip foot
Figure 7:
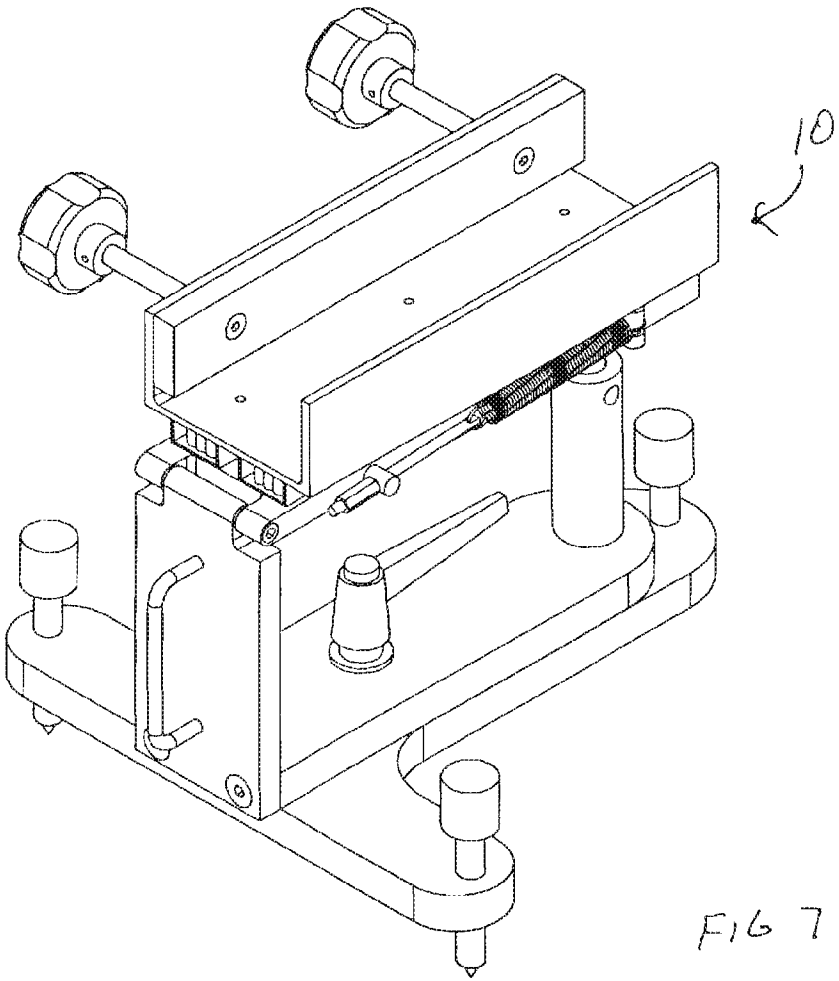
FIG. 7 is a perspective view of the device without the grip foot.

Referring to FIGS. 1, 2, and 5, the apparatus 10 comprises of a T-shaped support base 20. The front 12 of the apparatus 10 partially comprises the wide top of the T-shaped support base 20. The rear 14 of the apparatus 10 is partially comprised of the tail of the support base 20. The support base 20 further comprises three separate base height adjustments 22. Each height adjustment 22 is further comprised of a knurled knob 23 atop a threaded shaft 24 which adjustably fits within three outward positions of the support base 20. Each knurled knob 23 provides positive and rapid finger adjustment. Each threaded shaft 24 is ideally fitted with a grip foot 25 on the bottom as a stabilizing accessory. With three base height adjustments 22, the support base 20 can be adjusted both up and down and side to side. The T-shaped support base 20 with three outwardly positioned base height adjustments 22 provides that only three base height adjustments 22, and not four, are capable of correctly adjusting fore, aft, and side tilt of the support base 20 as desired. The horizontal pivot bolt 43 is affixed upwardly to the support base 20 proximal to the front 12 of the apparatus. The horizontal pivot bolt 43 is, in alternate embodiments, disposed more closely to the center of the support base 20. The pivot bolt passes through the plate orifice 50.

The horizontal lever 41 is loosened to allow the horizontal adjustment plate 45 to pivotally move side to side as desired, about the pivot bolt 43. The lever 41 is tightened to secure the horizontal adjustment plate 45 as desired.

Referring further to FIG. 5, the horizontal adjustment vertical 46 is attached to the front of the horizontal adjustment plate 45. Recessed fasteners 34 are countersunk into the horizontal adjustment vertical 46. The handle 65 is affixed to the horizontal adjustment vertical 46 for easy carry of the apparatus 10. The vertical adjustment base 80 has a first end and a second end. The first end of the vertical adjustment base 80 is attached to the horizontal adjustment vertical 46 via the hinge 71 aided by bushings 72.

Referring further to FIGS. 1, 2, and 5, the vise 90 is fitted atop the vertical adjustment base 80 via a pair of spaced apart slides 85. Each slide 85 is fitted with bearings (not shown). The slides 85 provide for precise fore and aft travel of the vice 90 atop the vertical adjustment base 80. The slides 85 and travel of the vice 90 are limited in forward movement via the stops 86 at the front of the slides 85. The rearward motion of the vice 90 is cushioned by the extension recoil reduction springs 117 which are fastened to each side of the vice 90 and to each side of the vertical adjustment base 80. A significant amount of a firearm's recoil is absorbed via the slides 85 and reduction springs 117 without the firearm losing acquired target and without barrel elevation. The precise fore and aft movement of the rifle recoil provides for the shooter to remain focused on the given target. The vice 90 is comprised of the vice floor 92 bounded by spaced apart walls 91.

The spaced apart threaded apertures 93 in one vice wall 91 provide for the threaded fit of the vice adjustment bolts 94. Turning each adjustment bolt 94 via each vice adjustment knob 95 moves the vice adjustment member 101 inwardly and outwardly as chosen. Each vice adjustment bolt 94 is fitted with a vice adjustment knob 95 for ease in hand/finger adjustment and tightening of the vice 90 about a firearm forestock. Firearms are cushioned in vice 90 contact via the elastomeric material 35 which covers the interior of the vice walls 91 and the vice floor 92. Elastomeric material 35 also provides better grip of firearms.

Referring further to FIGS. 2 and 5, the rear of the horizontal adjustment plate 45 is fitted with the hollow vertical cylinder 49. The rod 47 fits slideably within the cylinder 49. The rod 47 supports the second end of the vertical adjustment base 80. The compression spring 118 assists in the support of the vertical adjustment base 80 when weighted by a firearm. The safety cable 53 is attached to the vertical adjustment base 80 and loops around the vertical adjustment knob 51. The adjustment knob 51 selectively locates and secures the vertical rod 47 within the cylinder 49 thereby setting the height of the rear of the vertical adjustment base 80 as desired. The safety cable prevents explosive release of the vertical rod 47. The combination of the hinge 71 and the spring 118 loaded rod 47 within the cylinder 49 provide easy and rapid adjustment of the vertical adjustment base 80 both upwardly and downwardly.

Figure 4:
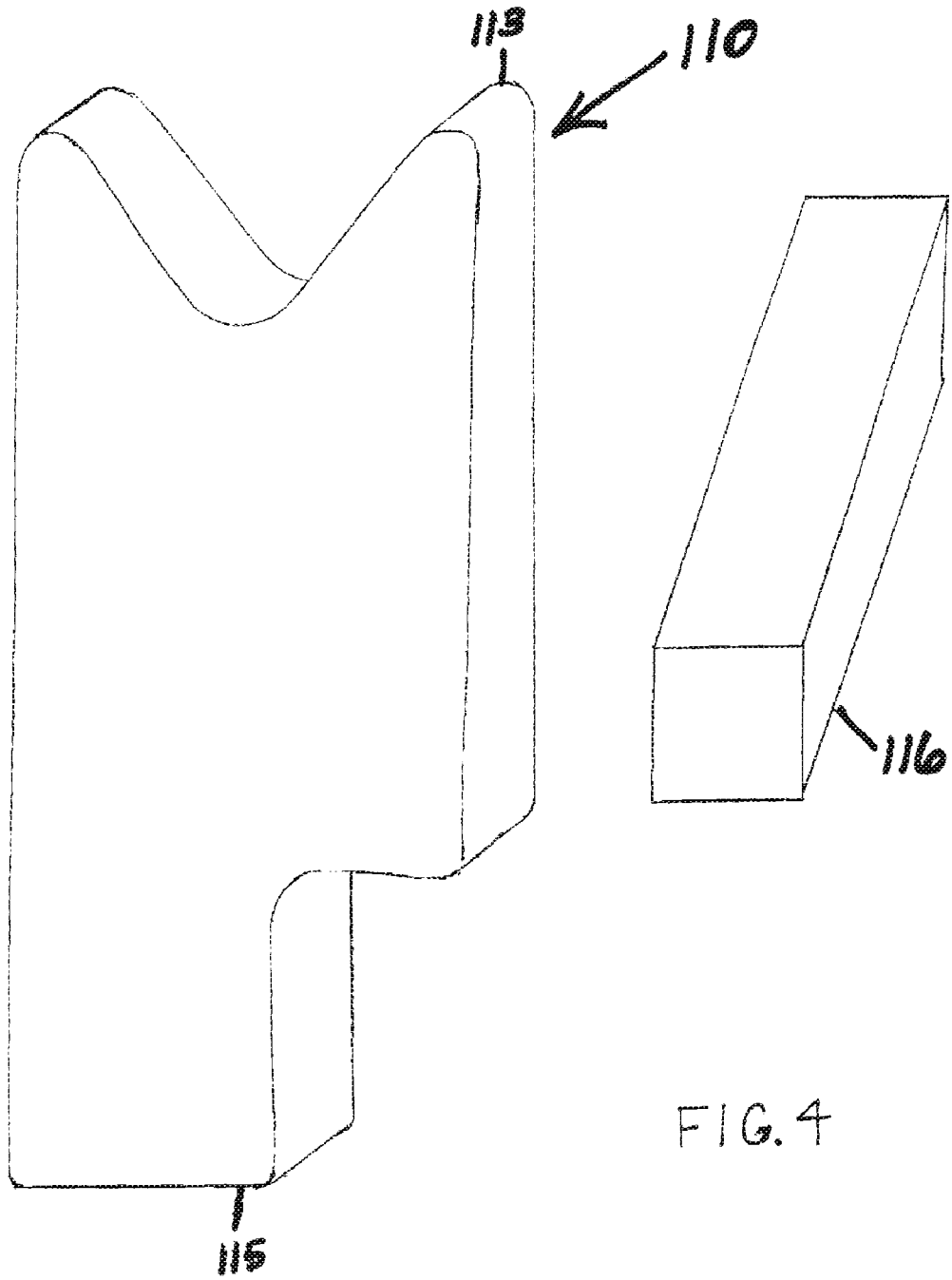
FIG. 4 is a perspective view of the pistol rest and V-block.

Referring to FIG. 4, the pistol rest 110 is provided for selective fit within the vice 90. The spacer block 116 is also fitted within the vice 90 in order that the vice 90 provides even pressure on the pistol rest 110.

The pistol rest 110 is further comprised of the V-block 113 in the top of the rest for support of a pistol barrel. The rest bottom 115 is of reduced width as compared to the upper portion of the pistol rest 110. The spacer block 116 also provides pistol support. The same adjustments of the apparatus 10 as outlined above may be employed for desired adjustment in pistol support.

Referring again to FIGS. 1 and 2, the recoil reduction mechanism comprises recoil reduction spring 117 tension adjustment capability. The first end of each recoil reduction spring 117 is attached to the vice 90 via the shoulder bolt 122. The second end of the recoil reduction spring 117 is attached to the first end of the reduction arm 120. The second, threaded end of the reduction arm 120 passes through the reduction anchor 124. The reduction anchor 124 is affixed to the vertical adjustment base 80. The tension adjustment nut 126, which is threaded onto the second end of the reduction arm 120 is turned to increase and to decrease, respectively, recoil reduction spring 117 tension.

The various adjustments and design features of the apparatus 10 invite custom use as desired without limitation to strict guidelines.

With respect to the above description then, it is to be realized that the optimum dimensional relationships for the parts of the shooting rest apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present shooting rest apparatus.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present shooting rest apparatus may be used.

Therefore, the foregoing is considered as illustrative only of the principles of the shooting rest apparatus. Further, since numerous modifications and changes will readily occur to those skilled in the art, it is not desired to limit the shooting rest apparatus to the exact construction and operation shown and described, and accordingly, all suitable modifications and equivalents may be resorted to, falling within the scope of the shooting rest apparatus.

What is claimed is:

1. What is claimed is a shooting rest apparatus for securing the forestock of a rifle or smoothbore firearm, the apparatus comprising:

a T-shaped support base having a front and a rear;

three spaced apart support base height adjustments, each disposed in an outward position on the support base, two support base height adjustments proximal to the front and one proximal to the rear of the support base;

a horizontal adjustment plate pivotally attached to the support base, the plate having a front and a rear coincidental with the front and rear of the support base;

means for selectively securing the pivotal attachment of the horizontal adjustment plate to the support base;

a horizontal adjustment vertical attached to the front of the horizontal adjustment plate;

a handle vertically attached to the horizontal adjustment vertical;

a vertical adjustment base having a first end and a second end, the first end hingedly attached to the horizontal adjustment vertical;

a cylinder affixed to a top of the rear of the horizontal adjustment plate;

a compression spring within the cylinder;

a rod slideably contained within the cylinder and atop the compression spring, the rod supporting the second end of the vertical adjustment base;

means for selectively locating the rod within the cylinder;

a vice attached to a top of the vertical adjustment base, the vice for selectively securing the forestock of the rifle.

2. The apparatus according to claim 1 wherein each spaced apart support base height adjustments is further comprised of a threaded shaft for receipt through the support base;

a knurled knob on a top of each threaded shaft, thereby enabling fingertip adjustment of the support base height adjustments.

3. The apparatus according to claim 2 wherein the means for selectively securing the pivotal attachment of horizontal adjustment plate to the support base further comprises a horizontal pivot bolt within the support base;

a plate orifice within the horizontal adjustment plate;

a horizontal lever for tightening the horizontal adjustment plate to the pivot bolt.

4. The apparatus according to claim 3 wherein the means for selectively locating the rod within the cylinder further comprises a vertical adjustment knob;

a safety cable attached to the vertical adjustment base and selectively looped around the vertical adjustment knob.

5. The apparatus according to claim 2 wherein the means for selectively locating the rod within the cylinder further comprises a vertical adjustment knob;

a safety cable attached to the vertical adjustment base and selectively looped around the vertical adjustment knob.

6. The apparatus according to claim 1 wherein the means for selectively securing the pivotal attachment of horizontal adjustment plate to the support base further comprises a horizontal pivot bolt within the support base;

a plate orifice within the horizontal adjustment plate;

a horizontal lever for tightening the horizontal adjustment plate to the pivot bolt.

7. The apparatus according to claim 6 wherein the means for selectively locating the rod within the cylinder further comprises a vertical adjustment knob;

a safety cable attached to the vertical adjustment base and selectively looped around the vertical adjustment knob.

8. The apparatus according to claim 1 wherein the means for selectively locating the rod within the cylinder further comprises a vertical adjustment knob;

a safety cable attached to the vertical adjustment base and selectively looped around the vertical adjustment knob.

9. What is claimed is a shooting rest apparatus for securing the forestock of a rifle or smoothbore firearm, the apparatus comprising:

a T-shaped support base having a front and a rear;

three spaced apart support base height adjustments, each disposed in an outward position on the support base, two support base height adjustments proximal to the front and one proximal to the rear of the support base;

a horizontal adjustment plate pivotally attached to the support base, the plate having a front and a rear coincidental with the front and rear of the support base;

means for selectively securing the pivotal attachment of the horizontal adjustment plate to the support base;

a horizontal adjustment vertical attached to the front of the horizontal adjustment plate;

a handle vertically attached to the horizontal adjustment vertical;

a vertical adjustment base having a first end and a second end, the first end hingedly attached to the horizontal adjustment vertical;

a cylinder affixed to a top of the rear of the horizontal adjustment plate;

a compression spring within the cylinder;

a rod slideably contained within the cylinder and atop the compression spring, the rod supporting the second end of the vertical adjustment base;

means for selectively locating the rod within the cylinder;

a pair of spaced apart bearinged slides fitted on a top of the vertical adjustment base;

a vice, the vice comprising:

a pair of spaced apart vice walls attached to a vice floor, the vice floor attached to a top of the bearinged slides, thereby enabling fore and aft movement of the vice atop the slides and the vertical adjustment base;

a vice adjustment member for selectively securing the firearm forestock between one of the vice walls and the vice adjustment member;

at least two knobbed adjustment bolts for tightening and loosening the vice adjustment member;

a pair of recoil reduction springs, a one end of each spring attached to a rear of the vice, an opposite end of each spring attached to the vertical adjustment base;

a pair of stops, one of each stop disposed at a front of each bearinged slide.

10. The apparatus according to claim 9 wherein each spaced apart support base height adjustments is further comprised of a threaded shaft for receipt through the support base;

a knurled knob on a top of each threaded shaft, thereby enabling fingertip adjustment of the support base height adjustments.

11. The apparatus according to claim 10 wherein the means for selectively securing the pivotal attachment of horizontal adjustment plate to the support base further comprises a horizontal pivot bolt within the support base;

a plate orifice within the horizontal adjustment plate;

a horizontal lever for tightening the horizontal adjustment plate to the pivot bolt.

12. The apparatus according to claim 11 wherein the means for selectively locating the rod within the cylinder further comprises a vertical adjustment knob;

a safety cable attached to the vertical adjustment base and selectively looped around the vertical adjustment knob.

13. The apparatus according to claim 10 wherein the means for selectively locating the rod within the cylinder further comprises a vertical adjustment knob;

a safety cable attached to the vertical adjustment base and selectively looped around the vertical adjustment knob.

14. The apparatus according to claim 9 wherein the means for selectively securing the pivotal attachment of horizontal adjustment plate to the support base further comprises a horizontal pivot bolt within the support base;

a plate orifice within the horizontal adjustment plate;

a horizontal lever for tightening the horizontal adjustment plate to the pivot bolt.

15. The apparatus according to claim 14 wherein the means for selectively locating the rod within the cylinder further comprises a vertical adjustment knob;

a safety cable attached to the vertical adjustment base and selectively looped around the vertical adjustment knob.

16. The apparatus according to claim 9 wherein the means for selectively locating the rod within the cylinder further comprises a vertical adjustment knob;

a safety cable attached to the vertical adjustment base and selectively looped around the vertical adjustment knob.

17. What is claimed is a shooting rest apparatus for securing the forestock of a rifle and for supporting a pistol, the apparatus comprising:

a T-shaped support base having a front and a rear;

three spaced apart support base height adjustments, each disposed in an outward position on the support base, two support base height adjustments proximal to the front and one proximal to the rear of the support base;

a horizontal adjustment plate pivotally attached to the support base, the plate having a front and a rear coincidental with the front and rear of the support base;

means for selectively securing the pivotal attachment of the horizontal adjustment plate to the support base, comprising;

a horizontal pivot bolt within the support base;

a plate orifice within the horizontal adjustment plate;

a horizontal lever for tightening the horizontal adjustment plate to the pivot bolt;

a horizontal adjustment vertical attached to the front of the horizontal adjustment plate;

a handle vertically attached to the horizontal adjustment vertical;

a vertical adjustment base having a first end and a second end, the first end hingedly attached to the horizontal adjustment vertical;

a cylinder affixed to a top of the rear of the horizontal adjustment plate;

a compression spring within the cylinder;

a rod slideably contained within the cylinder and atop the compression spring, the rod supporting the second end of the vertical adjustment base;

means for selectively locating the rod within the cylinder, comprising:

a vertical adjustment knob;

a safety cable attached to the vertical adjustment base and selectively looped around the vertical adjustment knob;

a pair of spaced apart bearinged slides fitted on a top of the vertical adjustment base;

a vice, the vice comprising:

a pair of spaced apart vice walls attached to a vice floor, the vice floor attached to a top of the bearinged slides, thereby enabling fore and aft movement of the vice atop the slides and relative to the vertical adjustment base;

a vice adjustment member for selectively clamping the firearm forestock between one of the vice walls and the vice adjustment member;

at least two knobbed adjustment bolts for tightening and loosening the vice adjustment member;

a pair of recoil reduction springs, a one end of each spring attached to a rear of the vice, an opposite end of each spring attached to the vertical adjustment base;

a pair of stops, one of each stop disposed at a front of each bearinged slide;

a pistol rest having a height and a width, the rest comprising:

a V-block at a top of the rest;

a rest bottom, the rest bottom of a reduced width in comparison to the rest top, the rest bottom for selective fit within the vice.

18. The apparatus according to claim 17 wherein an interior of the vice adjustment member and one wall of the vice are further comprised of an elastomeric material.

19. The apparatus according to claim 18 wherein the recoil reduction springs further comprise tension adjustment capability.

20. The apparatus according to claim 19 wherein the recoil reduction springs further comprise tension adjustment capability.

* * * * *